US009734810B2

(12) United States Patent
Swiggett et al.

(10) Patent No.: US 9,734,810 B2
(45) Date of Patent: Aug. 15, 2017

(54) AUTOMATIC HARMONY GENERATION SYSTEM

(71) Applicant: The Melodic Progression Institute LLC, Seattle, WA (US)

(72) Inventors: Clifton S. Swiggett, Seattle, WA (US); Stefon D. Harris, West Orange, NJ (US)

(73) Assignee: The Melodic Progression Institute LLC, Seattle, WA (US)

( * ) Notice: Subject to any disclaimer, the term of this patent is extended or adjusted under 35 U.S.C. 154(b) by 0 days.

(21) Appl. No.: 15/217,707

(22) Filed: Jul. 22, 2016

(65) Prior Publication Data

US 2017/0084258 A1 Mar. 23, 2017

Related U.S. Application Data

(60) Provisional application No. 62/222,602, filed on Sep. 23, 2015.

(51) Int. Cl.

| | |
|---|---|
| ***G10H 1/38*** | (2006.01) |
| ***G10H 7/00*** | (2006.01) |
| ***G10H 1/00*** | (2006.01) |

(52) U.S. Cl.

CPC ..... *G10H 1/0025* (2013.01); *G10H 1/383* (2013.01); *G10H 2210/111* (2013.01); *G10H 2240/085* (2013.01); *G10H 2250/005* (2013.01)

(58) Field of Classification Search

CPC ..... G10H 1/0025; G10H 1/383; G10H 2210/111; G10H 2240/085; G10H 2250/005

USPC ..... 84/613

See application file for complete search history.

(56) References Cited

U.S. PATENT DOCUMENTS

| | | | | |
|---|---|---|---|---|
| 5,052,267 | A * | 10/1991 | Ino | G10H 1/38 84/613 |
| 2005/0109194 | A1* | 5/2005 | Gayama | G10H 1/00 84/613 |
| 2009/0151547 | A1* | 6/2009 | Kobayashi | G10G 3/04 84/613 |
| 2015/0255052 | A1* | 9/2015 | Rex | G10H 1/0025 84/622 |
| 2016/0148604 | A1* | 5/2016 | Minamitaka | G10H 1/0025 84/613 |

* cited by examiner

*Primary Examiner* — Jeffrey Donels

(74) *Attorney, Agent, or Firm* — Perkins Coie LLP

(57) ABSTRACT

A music composition and training system includes: identifying a first chord of a chord progression. Then, for multiple iterations, the system includes selecting a chord of the chord progression, beginning with the identified first chord, and: identifying one or more potential subsequent chords in such a way that each of the potential subsequent chords provide a musical progression; applying weighted criteria to each of the potential subsequent chords; selecting a second chord based on the weighting while also providing variety and unpredictability; and combining the second chord into the chord progression. The system then uses the generated chord progression to generate or teach music.

20 Claims, 15 Drawing Sheets

AUTOMATIC HARMONY GENERATION SYSTEM

PRIORITY CLAIM

This application claims the benefit of U.S. Provisional Application No. 62/222,602, filed Sep. 23, 2015, which is incorporated herein by reference in its entirety.

BACKGROUND

Musicians spend years learning how to compose music that is both technically proficient and that flows for the listener. Learning these skill requires both an understanding of how chords interact and training the musician's ear to identify pleasing progressions. However, these skills can be difficult and time consuming to develop.

Figure 1:
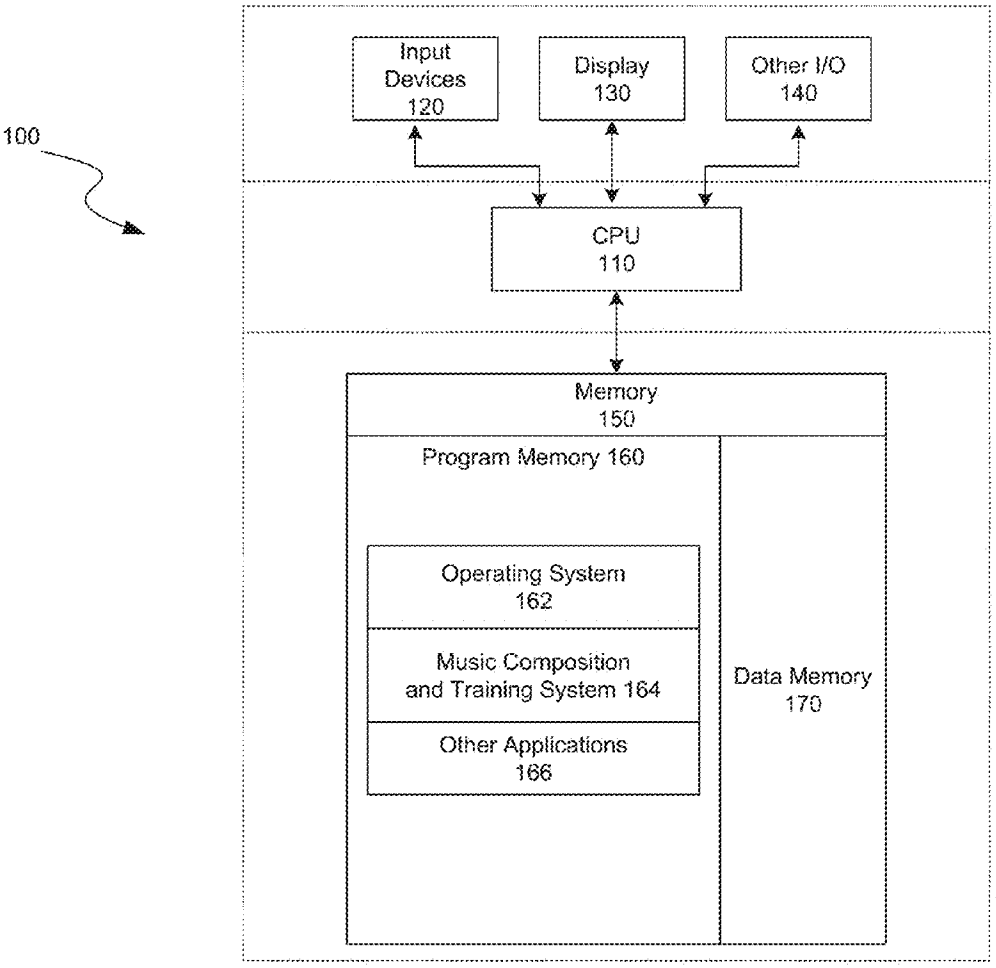
FIG. 1 is a block diagram illustrating an overview of devices on which some implementations of the disclosed technology can operate.

The drawings have not necessarily been drawn to scale. For example, the relative sizes of components in the figures may not be to scale. Similarly, some components and/or operations may be separated into different blocks or combined into a single block for the purposes of discussion of some of the embodiments of the disclosed system. Moreover, while the technology is amenable to various modifications and alternative forms, specific embodiments have been shown by way of example in the drawings and are described in detail below. The intention, however, is not to limit the technology to the particular embodiments described. On the contrary, the technology is intended to cover all modifications, equivalents and alternatives falling within the scope of the technology as defined by the appended claims.

The techniques introduced here may be better understood by referring to the following Detailed Description in conjunction with the accompanying drawings, in which like reference numerals indicate identical or functionally similar elements.

DETAILED DESCRIPTION

Described in detail herein is a music composition and training system that provides musicians of all skill levels the opportunity to learn and utilize aspects of music such as the language of harmony (including chords, intervals, and specific pitches).

The music composition and training system can incorporate a "Harmonic Pathways Database" comprising indications of chords and/or harmonic progressions that embody the foundation of some chord progressions.

The music composition and training system can incorporate algorithms for evolving and enhancing the Harmonic Pathways Database, e.g., by further classifying existing database elements or adding additional chords and/or harmonic progressions.

The music composition and training system can incorporate a tagging system that can enable manual or algorithmic selection of chords to be included in chord progressions based on one or more criteria including, but not limited to, musical genre, emotional content, harmonic density, and relation to key center. Thus, in one example, pathways can be created manually. When created manually, each pathway can be defined by a master musician to ensure the progression from one chord to the next is artful and musical. For instance, the musician or author of the pathways can define chord progressions that are smooth, that maintain a key center, that provide a variety of emotional transitions including tension and release, etc. In this way, the pathways can be hand curated and refined to achieve a high level of musicality.

The music composition and training system can incorporate a chord generator that can produce highly musical, unpredictable chord progressions based on selected chords, rules for shaping the musicality of progressions, melody lines, bass lines, or in response to live performances.

The music composition and training system can incorporate a music generator that can generate music, including bass line, harmony, melody, or rhythmic content.

The music composition and training system can incorporate interactive harmonic ear training exercises that utilizes the above elements.

The music composition and training system can incorporate a suite of applications that can utilize the above elements to enable users to perform a wide range of tasks including, but not limited to, learning to improvise, composing new chord progressions and songs, reharmonizing existing songs, performing unpredictable music live, generating music suited to certain applications (e.g., healing, meditation, worship, live performance accompaniment), etc.

Several implementations are discussed below in more detail in reference to the figures. Those skilled in the art will appreciate that the components illustrated in the figures may be altered in a variety of ways. For example, the order of the logic may be rearranged, substeps may be performed in parallel, illustrated logic may be omitted, other logic may be included, etc.

Illustrative Environment

FIG. 1 is a block diagram illustrating an overview of devices on which some implementations of the disclosed technology can operate. The devices can comprise hardware components of a device 100 that compose sounds and music or train users on various aspects of sound and music. Device 100 can include one or more input devices 120 that provide input to the CPU (processor) 110, notifying it of actions. The actions are typically mediated by a hardware controller that interprets the signals received from the input device and communicates the information to the CPU 110 using a communication protocol. Input devices 120 include, for example, a mouse, a keyboard, a touchscreen, an infrared sensor, a touchpad, a wearable input device, a camera- or image-based input device, a microphone, or other user input devices.

CPU 110 can be a single processing unit or multiple processing units in a device or distributed across multiple devices. CPU 110 can be coupled to other hardware devices, for example, with the use of a bus, such as a PCI bus or SCSI bus. The CPU 110 can communicate with a hardware controller for devices, such as for a display 130. Display 130 can be used to display text and graphics. In some examples, display 130 provides graphical and textual visual feedback to a user. In some implementations, display 130 includes the input device as part of the display, such as when the input device is a touchscreen or is equipped with an eye direction monitoring system. In some implementations, the display is separate from the input device. Examples of display devices are: an LCD display screen, an LED display screen, a projected, holographic, or augmented reality display (such as a heads-up display device or a head-mounted device), and so on. Other I/O devices 140 can also be coupled to the processor, such as a network card, video card, audio card, USB, firewire or other external device, camera, printer, speakers, CD-ROM drive, DVD drive, disk drive, or Blu-Ray device.

In some implementations, the device 100 also includes a communication device capable of communicating wirelessly or wire-based with a network node. The communication device can communicate with another device or a server through a network using, for example, TCP/IP protocols. Device 100 can utilize the communication device to distribute operations across multiple network devices.

The CPU 110 can have access to a memory 150. A memory 150 includes one or more of various hardware devices for volatile and non-volatile storage, and can include both read-only and writable memory. For example, a memory can comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. A memory is not a propagating signal divorced from underlying hardware; a memory is thus non-transitory. Memory 150 can include program memory 160 that stores programs and software, such as an operating system 162, music composition and training system 164, and other application programs 166. Memory 150 can also include data memory 170 that can include chords, pathways, chord progressions, compositions, tags for any of these elements, configuration data, settings, user options or preferences, etc., which can be provided to the program memory 160 or any element of the device 100.

Some implementations can be operational with numerous other general purposes or special purpose computing system environments or configurations. Examples of well-known computing systems, environments, and/or configurations that may be suitable for use with the technology include, but are not limited to, personal computers, server computers, handheld or laptop devices, cellular telephones, wearable electronics, tablet devices, multiprocessor systems, microprocessor-based systems, set-top boxes, programmable consumer electronics, network PCs, minicomputers, mainframe computers, distributed computing environments that include any of the above systems or devices, or the like.

Figure 2:
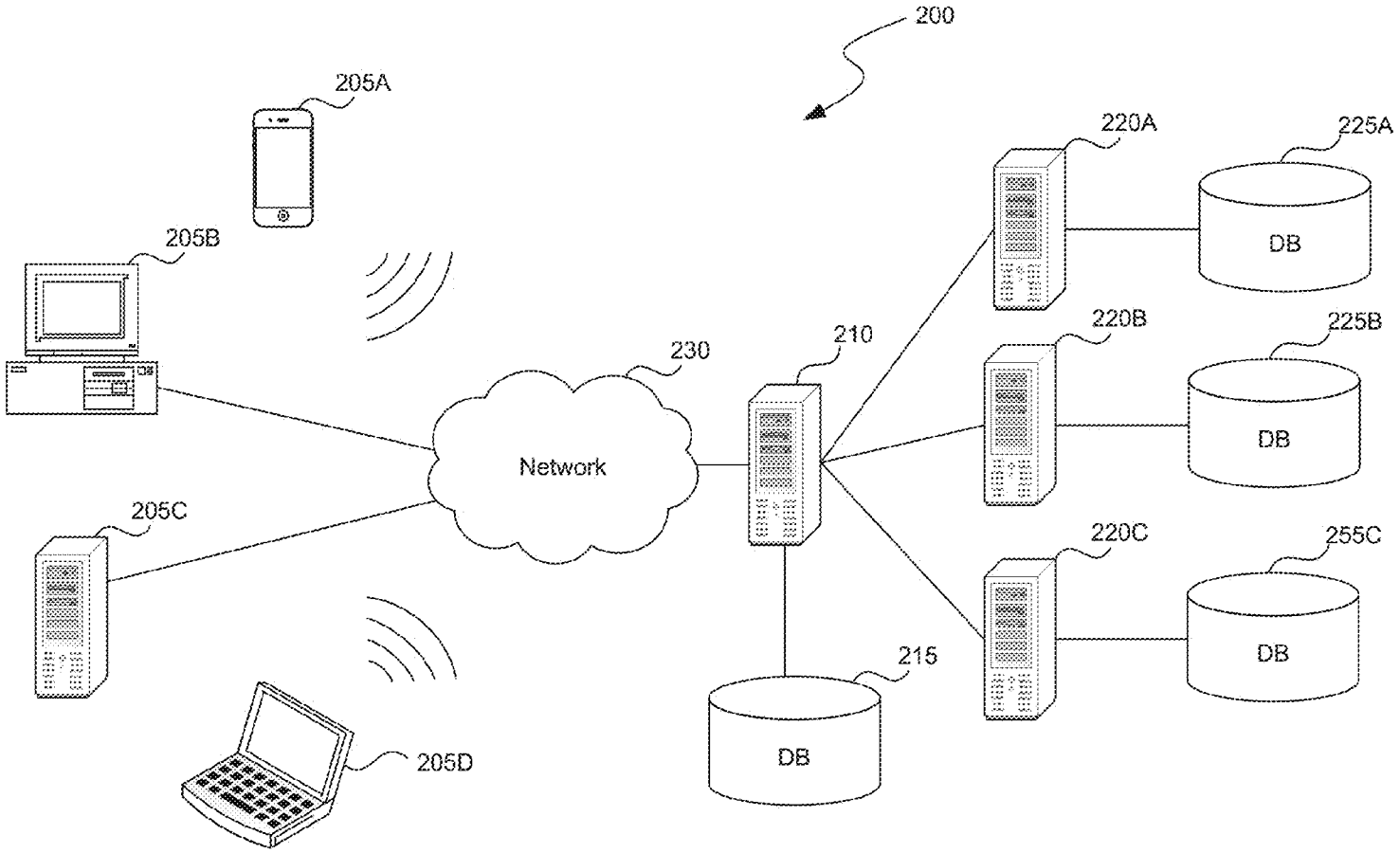
FIG. 2 is a block diagram illustrating an overview of an environment in which some implementations of the disclosed technology can operate.

FIG. 2 is a block diagram illustrating an overview of an environment 200 in which some implementations of the disclosed technology can operate. Environment 200 can include one or more client computing devices 205A-D, examples of which can include device 100. Client computing devices 205 can operate in a networked environment using logical connections 210 through network 230 to one or more remote computers, such as a server computing device.

In some implementations, server 210 can be an edge server which receives client requests and coordinates fulfillment of those requests through other servers, such as servers 220A-C. Server computing devices 210 and 220 can comprise computing systems, such as device 100. Though each server computing device 210 and 220 is displayed logically as a single server, server computing devices can each be a distributed computing environment encompassing multiple computing devices located at the same or at geographically disparate physical locations. In some implementations, each server 220 corresponds to a group of servers.

Client computing devices 205 and server computing devices 210 and 220 can each act as a server or client to other server/client devices. Server 210 can connect to a database 215. Servers 220A-C can each connect to a corresponding database 225A-C. As discussed above, each server 220 can correspond to a group of servers, and each of these servers can share a database or can have their own database. Though databases 215 and 225 are displayed logically as single units, databases 215 and 225 can each be a distributed computing environment encompassing multiple computing devices, can be located within their corresponding server, or can be located at the same or at geographically disparate physical locations.

Network 230 can be a local area network (LAN) or a wide area network (WAN), but can also be other wired or wireless networks. Network 230 may be the Internet or some other public or private network. Client computing devices 205 can be connected to network 230 through a network interface, such as by wired or wireless communication. While the connections between server 210 and servers 220 are shown as separate connections, these connections can be any kind of local, wide area, wired, or wireless network, including network 230 or a separate public or private network.

Harmonic Pathways Database

The Harmonic Pathways Database (HPD) can store pairs of chords. Each record in the database can be considered a harmonic "pathway." A pathway can identify two or more chords, which can have an identified sequence between them. A pathway can also identify additional features about a relationship between the chords such as a category. A pathway can also identify additional data such as musical features of the pathway. As discussed below, specific chord progressions can be generated by selecting a sequence of pathways. The essential elements of a pathway record in the HPD can be as shown in Table 1:

TABLE 1

| Chord | Categories | Next Chord | Next Categories | Additional Fields |
|---|---|---|---|---|
| C | P | F | P | |

In some implementations, the above fields of a pathway record can include the following details about a pathway:

Chord—A chord symbol identifying a first chord in a pathway.

Categories—A set of one or more tags that identify a musical role of the chord identified in the first Chord field of this pathway. 'P', for example, is shorthand for "Primary Triad in Root Position" and is a category based on the chord's musical relation to a key center. Categorization of the chord in the pathway is highly flexible and can include, but is not limited to, emotional quality, musical genre, relation to key center, etc.

Next Chord—An identification of a second chord determined to be a musically appropriate chord that can follow the combination of the first Chord given one of the listed Categories.

Next Categories—A set of categories, such as a category in the first Categories field, selected as being appropriate to the Next Chord.

Additional Fields—Other musical attributes of this pathway which can include, but are not limited to quadratic; pentatonic; hexatonic; full scale note patterns that can be used for improvisation or melody construction over this pathway; a source of the pathway (original author, song, etc.); workflow features such as whether the pathway has been approved, which products the pathway is included in; etc.

The chord and next chord fields can contain chord symbols. For instance:

C=C major triad

C−=C minor triad

Cdim=C diminished triad

C+=C augmented triad

C/E=C major triad in first inversion (e.g., with an E in the bass)

etc.

These chord symbols can adhere to existing conventions. The symbol can also indicate the preferred enharmonic spelling for the chord when it occurs in a particular pathway. For instance, while Eb−/Gb and D#−/F# represent the same chord, one or the other spelling may be preferred depending on where the chord will resolve (i.e. which chord comes next). Both of these (equivalent) symbols can be entered interchangeably in the pathways file with no effect on the chord progressions that will ultimately be generated. However, the chord symbol that is presented to the user can be derived from enharmonic spelling from the Chord column.

The chord categories can enable overlaying multiple different categorization schemes on top of the pathways. In some implementations, categorization is based on the chord's harmonic function and its distance from the key center. These categories can be defined in a separate table, such as shown in Table 2:

TABLE 2

| Category Name | Chord Group Prefix | Chord Group Friendly Name |
|---|---|---|
| Primary Triads | P | Major |
| Primary Triads | PM | Minor |
| Primary Triads | PA | Augmented |
| Primary Triads | PD | Diminished |
| Primary Triads | PS4 | Sus4 |
| Modal Exchange Triads | MX | Major |
| Modal Exchange Triads | MXM | Minor |
| Modal Exchange Triads | MXA | Augmented |
| Modal Exchange Triads | MXD | Diminished |
| Modal Exchange Triads | MXS4 | Sus4 |
| Transient Triads | T | Major |
| Transient Triads | TM | Minor |
| Transient Triads | TA | Augmented |
| Transient Triads | TD | Diminished |
| Transient Triads | TS4 | Sus4 |
| Non-Diatonic Triads | ND | Major |
| Non-Diatonic Triads | NDM | Minor |
| Non-Diatonic Triads | NDA | Augmented |
| Non-Diatonic Triads | NDD | Diminished |
| Non-Diatonic Triads | NDS4 | Sus4 |

Values stored in the category columns can include one of the "chord group prefixes" listed above as well as an optional inversion indicator. So, for instance:

ND=non-diatonic major triad in root position (i.e. chord root in the bass)

ND1=non-diatonic major triad in first inversion (i.e. third in the bass)

ND2=non-diatonic major triad in second inversion (i.e. fifth in the bass)

etc.

Several of the additional fields can be used to define scales that are mostly musically consonant with the "next chord" in the pathway. Different scales can be defined for each pathway including scales with just four notes ("Quadrads"), five notes ("Pentatonics"), six notes ("Hexatonics"), or more. Each note that is added beyond the chord tones is considered a "tension" note. The scales can be used in various ways including teaching improvisation, forming melodies, and embedding arpeggiated textures into music that will be generated. The values in the scale fields of the database can use a notation that builds on the related chord symbol and defines additional "tension notes" to be added. A non-exhaustive list of examples of this notation include:

C/Q2='Q' indicates a quadrad, 2 indicates add the major 2=C D E G

C/Q4=C E F G

Fsus4/PMaj9='P' indicates pentatonic, Maj indicates add the major 7, 9 indicates add the 9=F A C E G In some implementations, pathways in the HDP can be considered to be a single key and transposed to another key when used. For example, all pathways can be considered to be in the key of C and can be transposed to any key when chord progressions are generated.

The database can be populated in various ways, including hand curation, or harvesting of existing musical content. In some implementations, hand curated pathways can produce a database including over 6000 pathways. However, with the advent of digital standards for storing music (e.g., MusicXML) there is a large and growing body of music from which existing chord progression pathways can be algorithmically harvested and categorized using identified characteristics of the source music. These additional pathways can be used in addition to, or instead of, hand curated pathways.

The HPD can encode the "harmonic DNA" of chord progressions.

Generation of Chord Progressions

Figure 3:
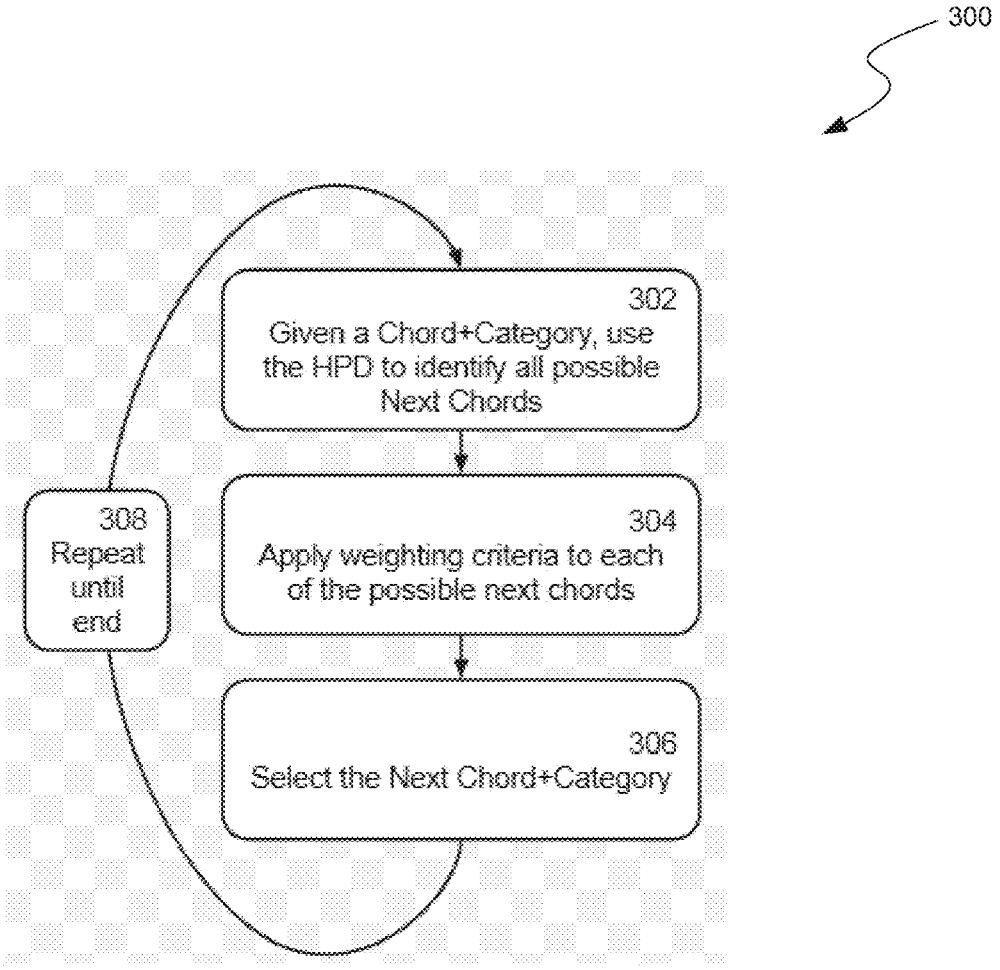
FIG. 3 is a flow diagram illustrating a process used in some implementations for generating chord progressions.

FIG. 3 is a flow diagram illustrating a process 300 used in some implementations for generating chord progressions. This can be accomplished by selecting a sequence of pathways where the Next Chord of a preceding pathway becomes the Chord of the following pathway.

At block 302, process 300 can use a given Chord and Category and a HPD to identify possible Next Chords.

At block 304, process 300 can apply weighting criteria. Applying weighting criteria can enable a highly flexible shaping of chord progressions. Additional details regarding weighting are discussed below in the section titled "Chord progression generation algorithm details." Weighting can include, but is not limited to:

- user selection of chords;
- automatic selection of chords for the purposes of adaptive learning;
- resolution to certain chords to, for example, complete a musical passage, execute a key change, or end a progression;
- maintain a statistical distribution of chords across the entire progression;
- emphasize certain categories of chords (e.g., emotion, genre, categories based on music theory);
- select chords that are musically aligned with other music—e.g., a melody, bassline, or live performance; or
- maintain other important musical qualities such as avoiding or employing repetition, creating phrasing around musical form, etc.

Chord progressions can be unpredictable. However, they are not accurately described as "random" because great care has been taken to ensure that the resulting music is beautiful and engaging and conforms to various criteria.

Chord progressions can be of any length, ranging from a single chord to never ending.

Complete chord progressions can be generated: prior to generation of music, in real-time as music is being played, or in response to music that is being played.

At block 306, process 300 can Select a Next Chord and Category.

At block 308, process 300 repeat steps 302-306 until and ending condition is met.

Chord Progression Generation Algorithm Details

When the application first loads, it can compile the HPD into an instance of class MPIChordMap. One method on MPIChordMap is given a "chordkey" (a combination of a normalized chord symbol and a category tag) and returns possible next chords that are defined in the HPD.

When new chord progressions are generated, a default first chord can be selected, such as the major tonic chord (e.g., C). Subsequent chords can be selected as shown in the following table 3 (note that this can be called repeatedly, on demand, to create never ending progressions).

TABLE 3

```
length = 1
bassline = [C_2]
chords = [C]
while length < N
    possibleNextChords =
    MPIChordMap.getNextChordsForPriorChord(chords.lastObject)
    apply_user_selection_weighting(possibleNextChords)
    if (possibleNextChords.length == 0)
        auto_insert_chord(possibleNextChords)
    apply_return_to_tonic_weighting(possibleNextChords, length, N)
    apply_antitoggling_weighting(possibleNextChords, chords)
    apply_distribution_weighting(possibleNextChords, chords)
    apply_bassline_shape_weighting(possibleNextChords, chords)
    nextChord = randomSelectFromWeightedArray(possibleNextChords)
    chords.add(nextChord)
    length = length+1
```

Each possible next chord can have a "weight" which can be a floating point value and which can be initially set to a default value, such as zero or one. Each of the apply_X_weighting steps above can involve modifying the weights of the possible next chords. Weights may be modified additively (e.g., a set value is added to the existing weight to produce a new weight) or multiplicatively (e.g., a set value is multiplied with the existing weight to produce a new weight).

One type of weighting can be based on user selection. This weighting can use a apply_user_selection_weighting function. This weighting can additively apply a weight based on which chords a user has selected. For example, if a user selects primary major triads, as well as non-diatonic major triads, just the chords in those categories will be given non-zero weighting. Note that the actual weights applied can be designed to automatically maintain a musical mix of chords that also stays rooted in the current key signature. In some implementations, the selection weighting formula depends on the category (e.g., primary triads, modal exchange triads, etc.), group (e.g., major, minor, etc.), and inversion of the selected using the following formula: selection_weight=POW(0.75, chord_category_index)*POW(0.85, chord_group_index)*POW(0.85, chord_inversion_index).

It is possible that a user will select a set of chords from which it isn't possible to generate music progressions. For example, selecting just augmented chords leaves no viable pathways because augmented chords only have pathways to non-augmented chords. This can create "dead-ends" in the generated chord progression. When dead ends occur, functionality to automatically insert chords (i.e. an "auto_insert" function) can choose connecting chords to complete the user's chord progression. Auto-inserted chords can be chosen from the existing pathways with a preference for chords that have been tagged as a "primary resolution" for the dead end chord and which have pathways back to one of the user selected chords. In this way we create an experience that is as musical as possible, while also honoring the user's selection.

Similar to "dead-ends" it is possible for a user to select chords that would result in "orphans"—i.e., chords that may not be reached via defined pathways from any of the user selected chords. Auto-inserted chords can be used to create musical connections to otherwise unreachable chords and ensure all user selected chords are included in chord progressions.

Another type of weighting can be based on tonic chord selection. This weighting can use an apply_return_to_tonic_weighting function. This weighting can apply multiplicative weighting that will direct the chord progression back to the tonic chord. In some implementations, this can be used to return to the tonic chord at the end of the progression. In some implementations, this technique can be used to resolve to any chord for the purposes of phrasing, key changes, etc. This can work by calculating the shortest path from all possible chords to the tonic chord. If the shortest path for a given chord exceeds the number of remaining chords in the progression, then its weight is multiplied by zero, effectively removing it as a possible chord.

Yet another type of weighting can prevent overly repetitive chord progressions. This weighting can use an apply_antitoggling_weighting function. This weighting can tend to prevent (but may not entirely eliminate) "toggling" chord progressions. This reduces the weight of a chord, in some implementations significantly, if it would result in a chord progression of the form X→Y→X→Y.

Some weighting can be based on a distribution implied by the user's chord selections. This weighting can use an apply_distribution_weighting function. This type of weighting can help to select chords such that, over time, the distribution of chords will tend to match the distribution implied by the user's chord selections. Because there can be an element of randomness in chord selection, it is possible for progressions to have chord distributions that are significantly different than those historically selected by the user. This weighting can be applied multiplicatively for each chord and can be calculated with the following formula: distribution_weight=((chord.expected_percent_of_all_chords*total_chords_played)+2.0)/(chord.actual_plays+2.0).

For example, if a chord is expected to be played 25% of the time, 10 chords have played, and the chord has not yet played, the distribution_weight would be ((0.25×10)+2)/(0+2.0)=2.25 (a significant boost). Similarly, if the chord had played more than expected, it's weight would be reduced.

A further type of weighting can be based on a user's preference for intervallic leaps. This weighting can use an apply_bassline_shape_weighting function. This type of weighting can be used to shape the bassline to conform to the user's preference for or against certain intervallic leaps (see Configuration and Settings below). Each chord has a specific bass note and weighting can be applied based on user preferences and other bassline shaping considerations.

Once weighting has been applied, a chord is chosen based on the weighted distribution of the possible chords, as in block 306. This choosing can use a randomization process with a distribution computed using the weighting.

Generation of Music

The disclosed technology can use a selection of chord progressions to generate music. Generation of music can include, but isn't necessarily limited to, generation of melodic lines, harmonic voicings, bass lines, and rhythm. Generated music can be played using the disclosed technology by assigning synthesized instruments to the various musical parts. Generated music can also be saved and distributed in other formats including MIDI, printed scores, MusicXML, etc.

A user has control over many qualities of the generated music including tempo, key signature, sounds, length of the music, and independent control of volume.

The music generation algorithm can include the ability to generate different voicings for chords, depending optionally on the bass and melody notes. In some implementations, a voicing algorithm works as follows:

Execute the following steps until a Low Interval Limit is exceeded. Then roll back the algorithm to prevent the lowest note of the voicing from matching the pitch (in any octave) of the bass note.

If the melody note is higher than a certain threshold (e.g., G_5), double it down an octave, insert the chord note that most closely bisects this octave, and then consider the lower octave note as the melody for the remainder of this algorithm.

Create a chord inversion that puts the melody note either at the top of the chord (if the melody note is in the chord) or as close to the top chord note as possible. Add this inversion with and without the lowest note.

Duplicate the melody note down an octave.

Drop the 2 (the second note from the top in step 3) down an octave.

Drop the 4 (the fourth note from the top in step 3) down an octave, unless is it the same as the melody note in which case copy it down an octave.

For lower pitched melody notes, it may be impossible to create a valid voicing due to Low Interval Limits (Low Interval Limit is a concept that defines the lowest pitches at which intervals can be clearly perceived without sounding muddy or indistinct.). In this case nil is returned and it's up to the caller to try again with a higher melody note.

Harmony Cloud™

Figure 4:
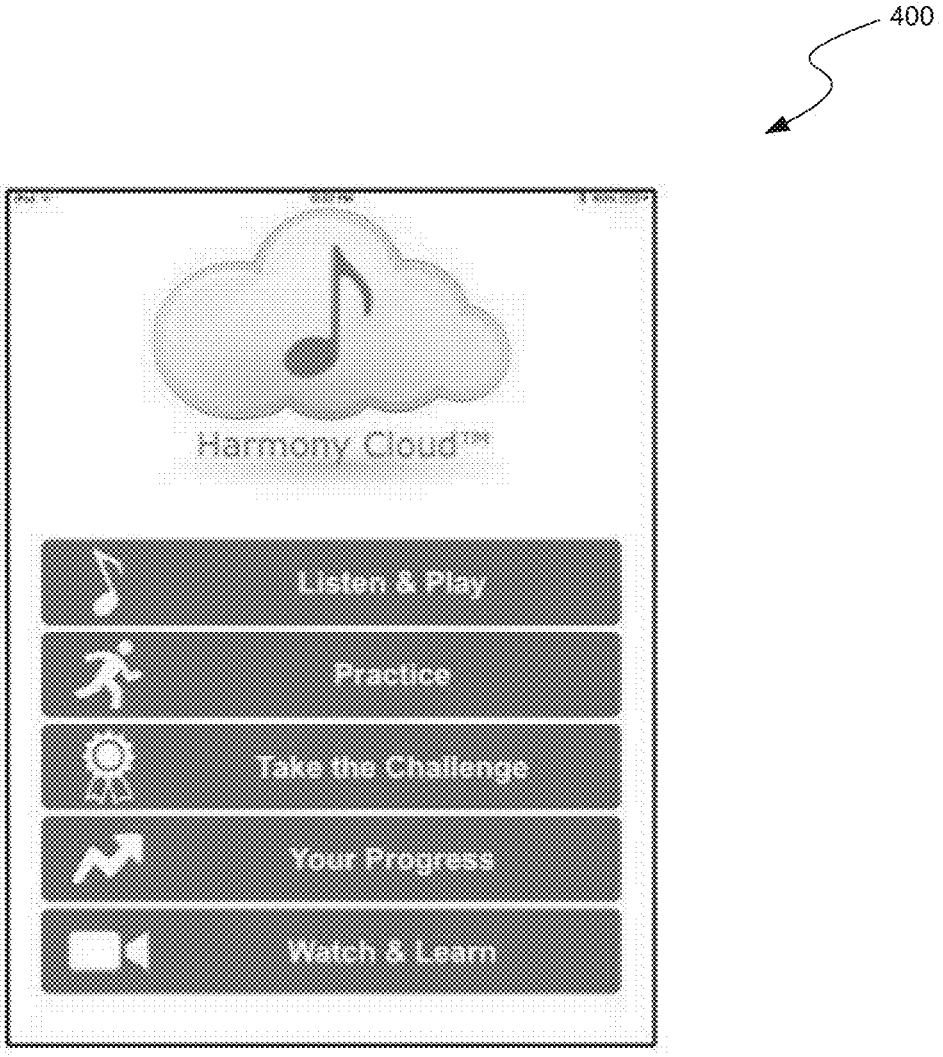
FIG. 4 shows a home screen GUI for some implementations of an app implementing the disclosed technology.

FIG. 4 shows a home screen GUI 400 for some implementations of an app implementing the disclosed technology. Individual features of the app are described subsequently.

Listen and Play

Figure 5:
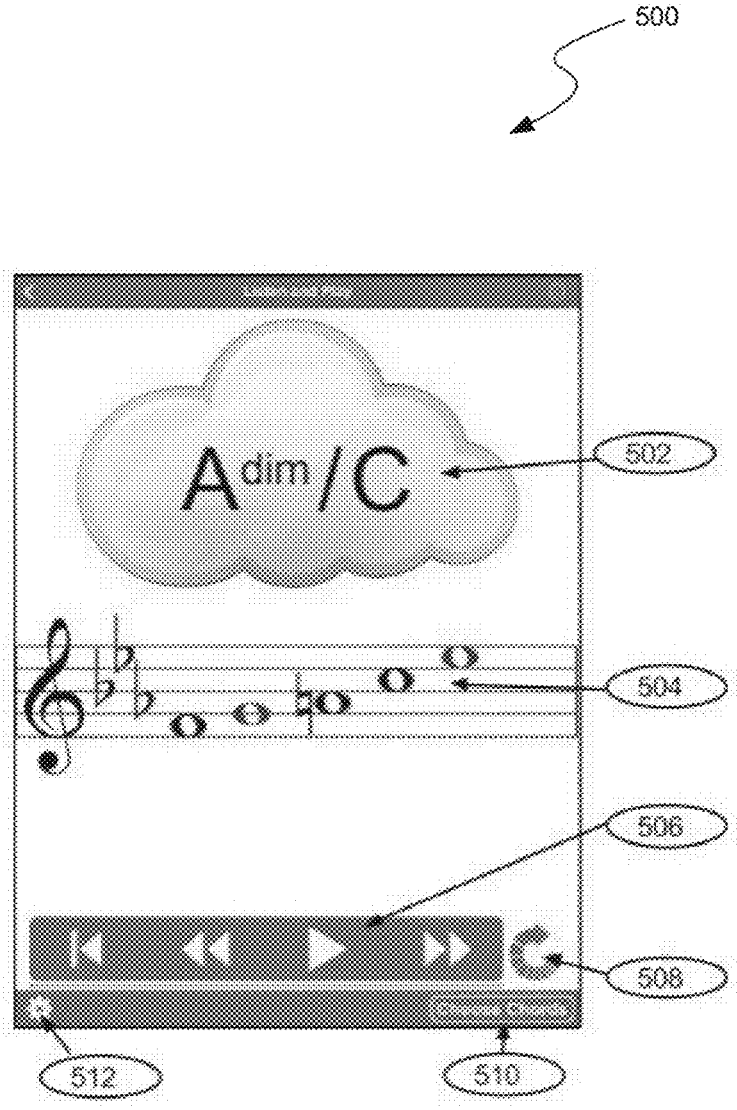
FIG. 5 shows a Listen and Play GUI for some implementations of an app implementing the disclosed technology.

A "Listen and Play" display can provide an open ended experience for a user to listen to generated music and play along with it using a separate instrument, his or her voice, or an instrument built into the application (e.g., a keyboard). FIG. 5 shows a Listen and Play GUI 500 for some implementations of an app implementing the disclosed technology. Some of the elements of this feature are depicted in FIG. 5 and include:

502—A representation of the chord that is playing which can be, but is not limited to, a chord symbol.

504—A staff presenting notes that can be used to improvise or construct melodies over this chord. Emotional and other qualities of notes may be color coded. For instance, some notes have more inherent tension, or levity, etc. This presentation can be derived from the scale fields in the Harmonic Pathways Database (see above). The staff may play as a user taps the notes.

506—A playback bar which allows play/pause, go to beginning, go to next chord, or go to previous chord. Note that while this playback bar appears to offer standard "tape recorder" features, it can also provide additional functionality in Harmonic Immersion (discussed below).

508—A button that generates new music. Each time this is pressed, entirely new and unpredictable music is generated, for example by choosing different semi-randomized chord progressions as discussed above.

510—An ability to choose your palette of chords (see "Choose Chords" below).

512—Additional settings (see "Configuration and Settings" below).

Harmonic Immersion

Figure 6:
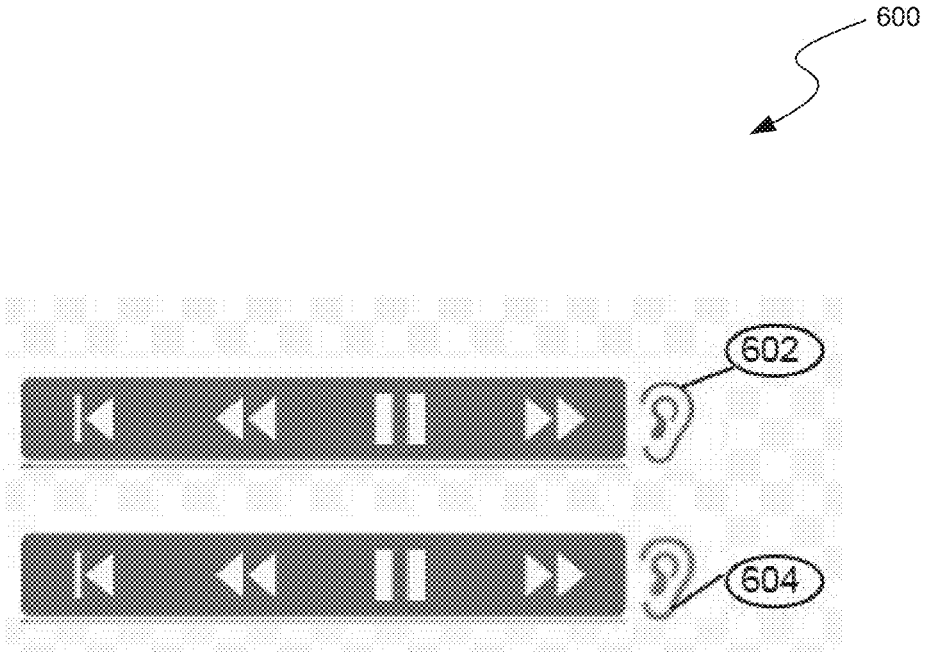
FIG. 6 shows a GUI for some implementations of an app implementing the disclosed technology where a generate music button turns into a sustain button.

Harmonic immersion enables a user to experience harmony deeply by letting the user slow down or completely suspend the tempo of the music. It also enables the user to independently lower or raise the volume of different parts of the music (e.g., bass, melody, harmony, certain chord tones in the harmony) so as to be able to better hear, feel, and absorb its harmonic content. As shown in FIG. 6, when music is playing the "generate music" button shown in FIG. 5, it turns into a "sustain" button (which can be shown as an ear).

When music is playing, the sustain button 602 appears. Sustain button 602 can be identified with a specific graphical attribute, such as a color or icon. For example, sustain button 602 can appear as a blue ear icon. When sustain is off, music plays in tempo and is synchronized to the rhythm track.

Tapping the sustain button 602 immediately sustains whatever music is playing (which can be indicated by a change in the appearance of sustain button 602, such as by changing the appearance to a red ear 604, as in FIG. 6). This feature can enable users to deeply experience harmony. During sustained playback, all notes (bass, harmony, and melody) can be sustained indefinitely. The user may still change volume of different parts of the music. Buttons on the playback bar 506 can be repurposed to allow users to move forward or backward in the music (to the beginning of the next or previous chord). After moving location in the music, sustained playback can continue. The new chord (harmony, melody, and bass) can play indefinitely. It is possible that the rhythm track will continue to play during sustained notes to maintain a rhythmic pulse.

Configuration and Settings

Figure 7:
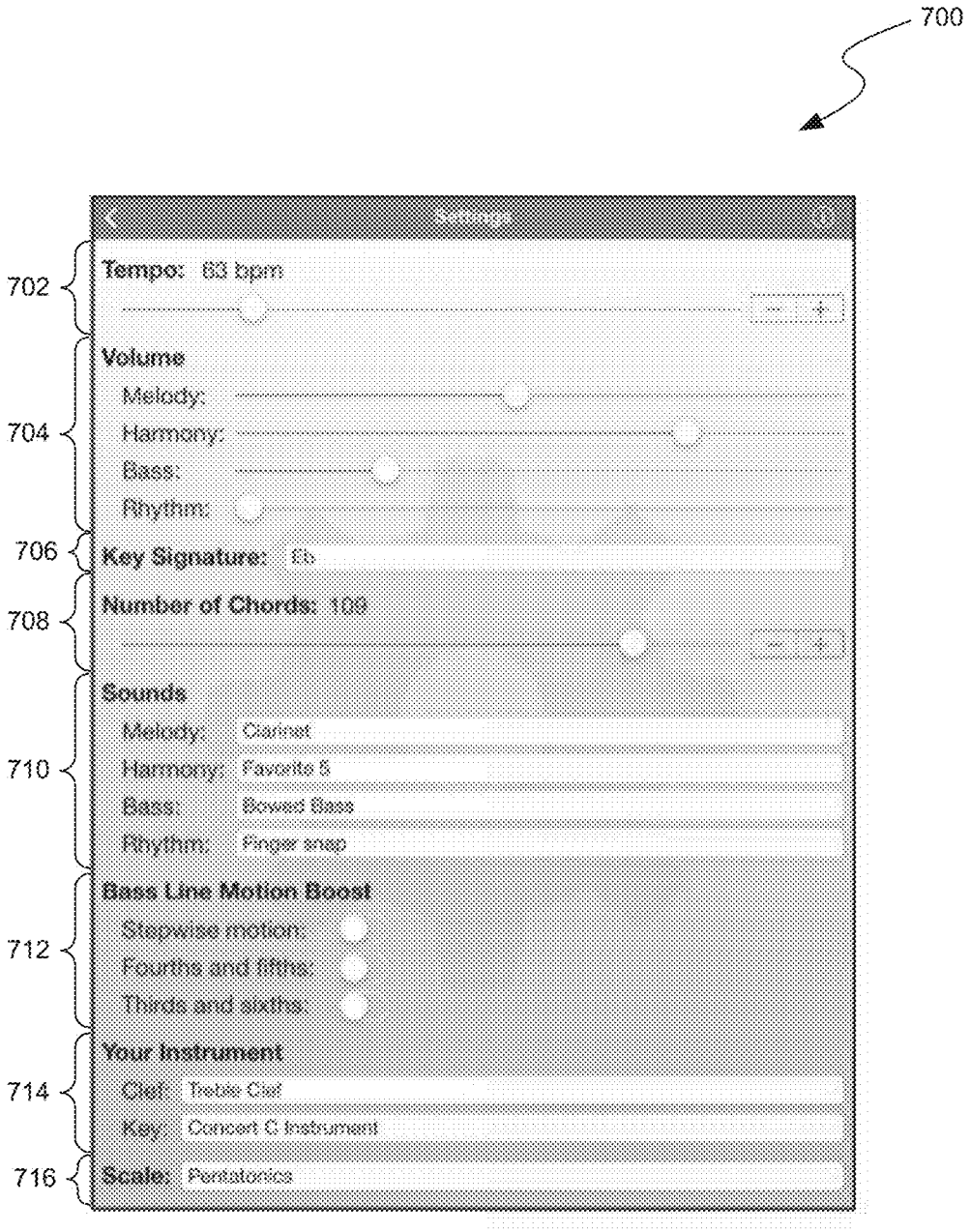
FIG. 7 shows a settings screen GUI for some implementations of an app implementing the disclosed technology.

Music generation and playback can be configured in many ways. FIG. 7 shows a settings screen GUI for some implementations of an app implementing the disclosed technology. The settings screen can allow users to control some settings such as:

702—Tempo can be changed from very slow (e.g., 4 beats per minute) to very fast (e.g., 300 bpm).

704—Volume of different elements of the music can be controlled independently.

706—The Key Signature of the music can be changed by selecting from a list of common key signatures.

708—The length of chord progressions can be set from just a few chords up to many (and possibly a never ending progression).

710—Under a Sounds section, controls such as drop down menus, allow the user to select sounds for various parts of the music that can be independently mapped to different synthesized instruments. Many of these sounds can be specially designed to be sustained to support Harmonic Immersion. Additional sounds can be available as add-ons. Also, more complex rhythm packs (aka "beats") can be made available, e.g., as downloads.

712—Settings can also be used to change different aspects of music generation. As an example, a Base Line Motion Boost section allows the user to control the shape of the bass line, thus enabling the user to emphasize different kinds of bass line motion. This can be particularly useful in helping a user learn to hear different kinds of bassline intervals. This is just one of many aspects of the generated music that could be controlled as a setting.

714—Your instrument can enable a user to personalize the app to reflect the staff (e.g., Bass or Treble) that the user prefers as well as the key of your instrument (e.g., 'Concert C', 'F Instrument', 'Bb Instrument', etc.).

716—The "Scale" setting can enable the user to modify the notes on the staff to show either just the notes in the chord, or four, five, six, or more notes that are recommended for improvisation and/or melody line development.

Choose Chords

Figure 8:
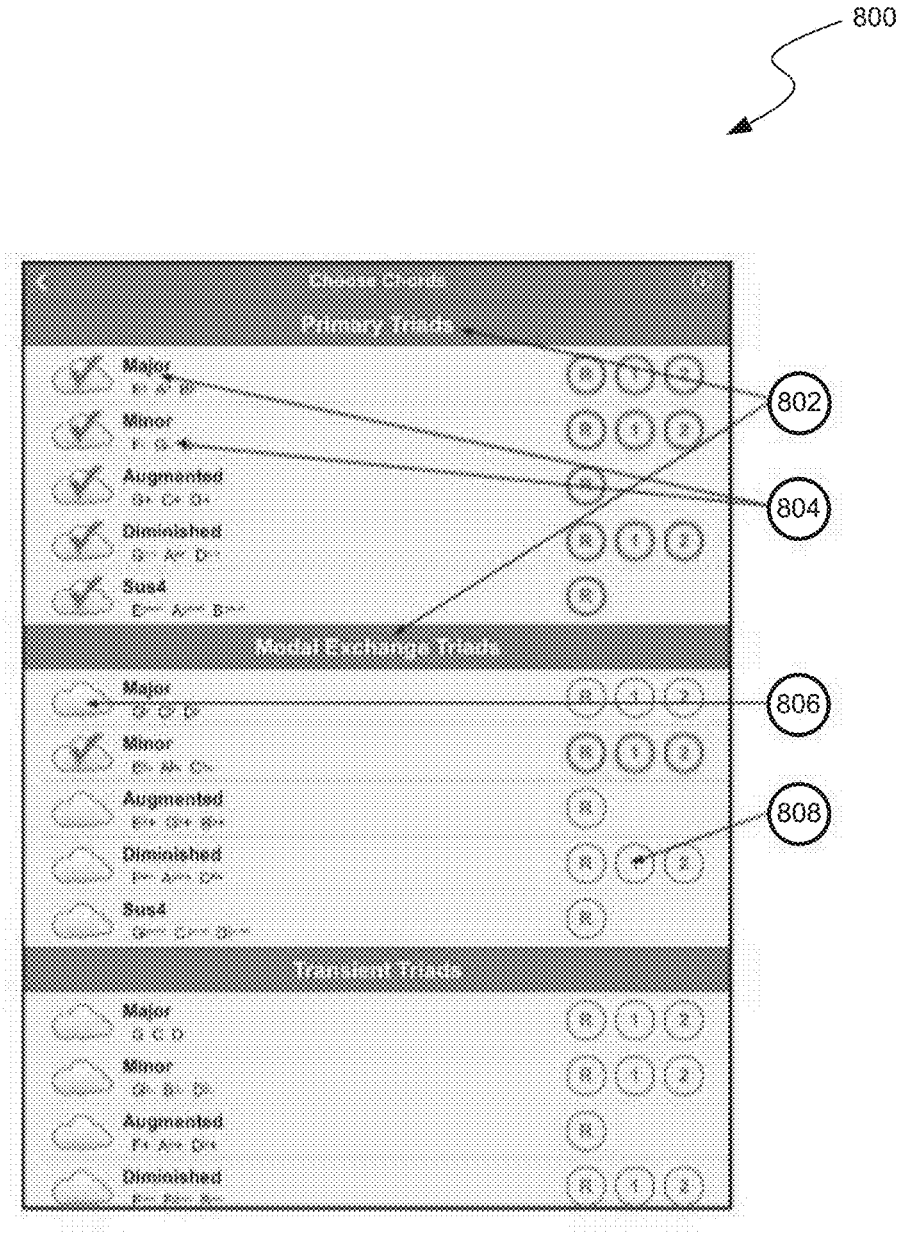
FIG. 8 shows a chords palette GUI for some implementations of an app implementing the disclosed technology.

FIG. 8 shows a chords palette GUI 800 for some implementations of an app implementing the disclosed technology. The user can choose from a large palette of chords to generate chord progressions. It is possible to group and categorize chords in many different ways.

Area 802 shows one case where triadic chords are presented in major categories related to their distance from the key center.

Area 804 shows, within each major category, chords can be further divided into groups of 3 chords each. By choosing one of these groups, the user can incrementally increase the breadth of harmony they are learning.

Area 806 shows that a user can select all chords in a group at once (by tapping the cloud).

Area 808 shows that a user can choose just a specific inversion of the chords by tapping one of the inversion buttons.

The scheme presented in FIG. 8 is one of many ways in which chords can be presented and grouped to facilitate a user choosing their harmonic palette. Chords could be grouped by emotional content (e.g., "Dark and Moody Chords"), by style (e.g., "Gospel Chords"), by harmonic density (e.g., "Five Note Chords"), by frequency used by a particular composer (e.g., "Coltrane's Favorite Chords" or "Chords from Debussy's Clair de Lune"), etc. Chords can be selected in groups, or individually. A chord can be in more than one group.

Chords may also be auto-selected to ensure musicality. It is possible for a user to select a set of chords which cannot be combined to create a musical progression (the consideration here is aesthetic), or which are inadequate to harmonize a melody (again, in a way that is beautiful), etc. If this occurs, additional chords can be auto-selected to complete the palette as described above.

Practice

Figure 9:
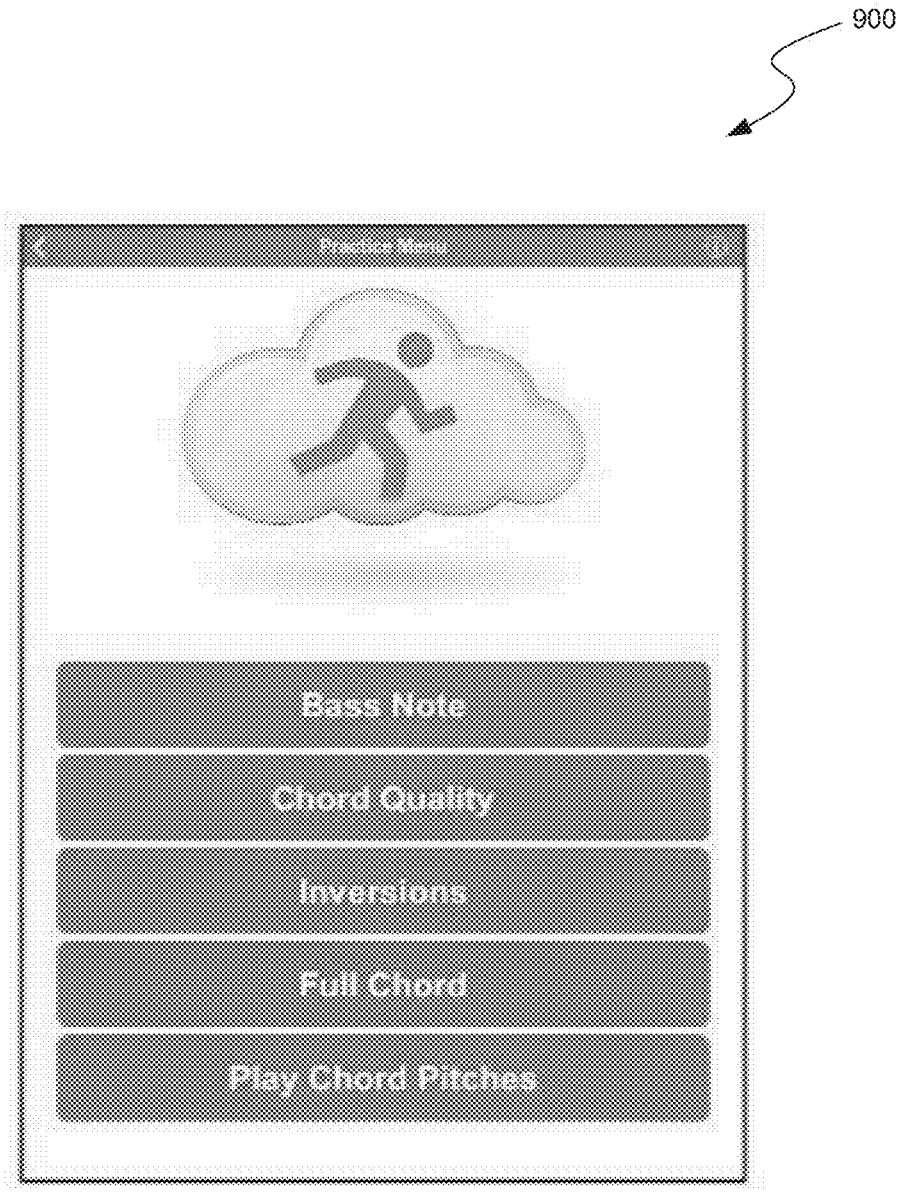
FIG. 9 shows a practice GUI for some implementations of an app implementing the disclosed technology.

FIG. 9 shows a practice GUI 900 for some implementations of an app implementing the disclosed technology. A suite of interactive methods to practice identifying chord progressions enables users to learn harmony in different ways.

During practice the user can be free to use the full capability of the playback bar, sustain button, generate music button, as well as all the settings and chord chooser. In this way, practice is very flexible, configurable, and forgiving and enables the user to experiment and try again after they have made mistakes. This is in contrast to the "Take the Challenge" feature of the app, discussed below.

Figure 10:
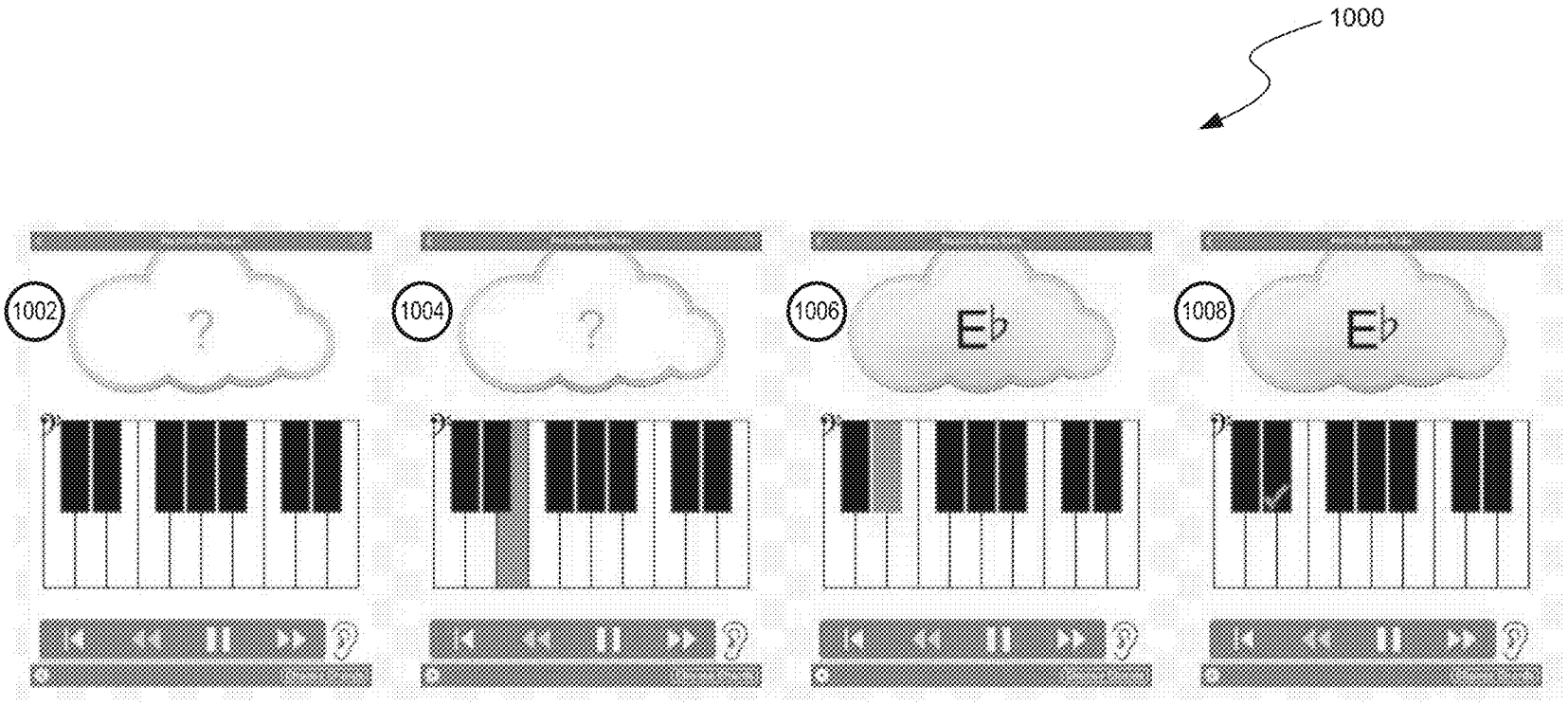
FIG. 10 shows a Practice Bass Note GUI for some implementations of an app implementing the disclosed technology.

FIG. 10 shows a Practice Bass Note GUI 1000 for some implementations of an app implementing the disclosed technology. Practice Bass Note GUI 1000 can be used in some implementations to focus a user on the pitch of a bass note. In some implementations, an operation sequence can include:

1002—A chord, including the bass note, plays.

1004—If a user plays an incorrect bass note on the provided keyboard, they will hear the incorrect pitch as well as receive visual feedback that the bass note they played was incorrect.

1006—Playing the correct pitch provides immediate positive feedback, and also reveals the chord that is playing.

1008—The music will continue to play in tempo. The user can use the playback bar to, for example, move to the next chord right away if they want to proceed more quickly.

Figure 11:
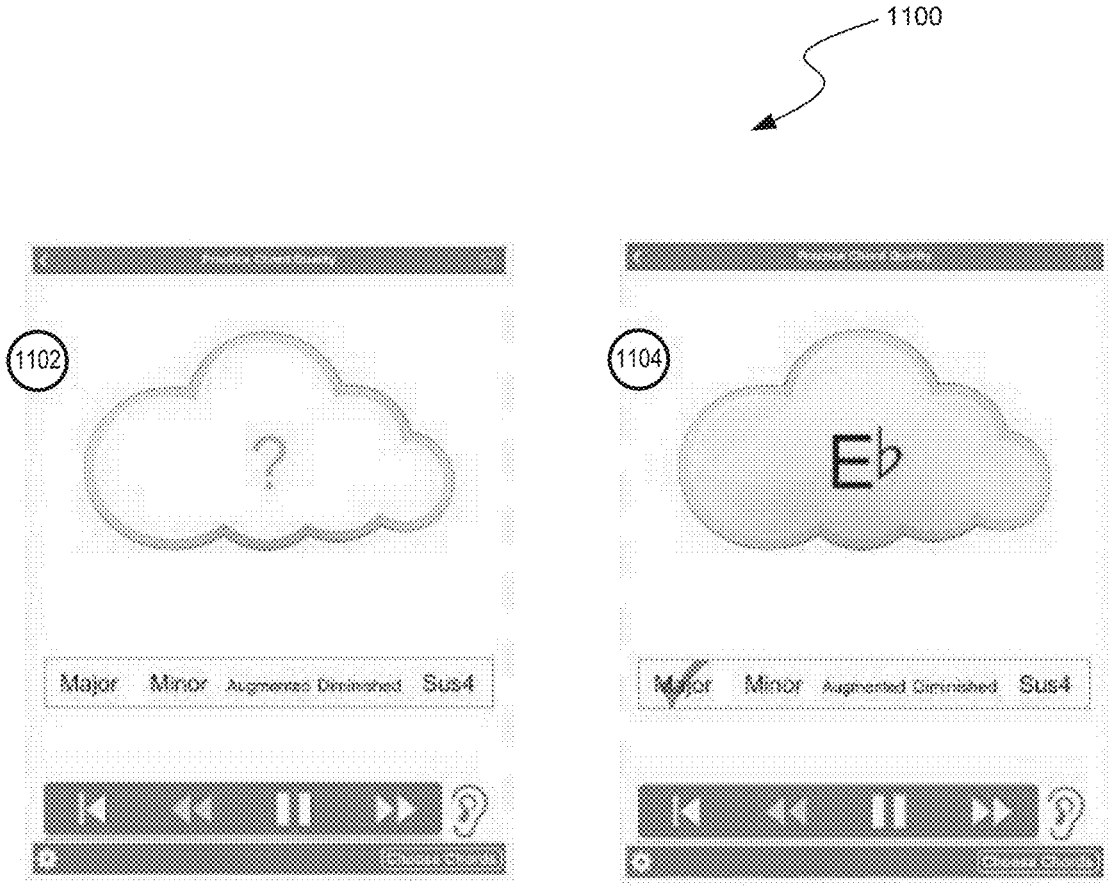
FIG. 11 shows a Practice Chord Quality GUI for some implementations of an app implementing the disclosed technology.

FIG. 11 shows a Practice Chord Quality GUI 1100 for some implementations of an app implementing the disclosed technology. Practice Chord Quality GUI 1100 can be used in some implementations to focus a user on the quality of the chord. In some implementations, an operation sequence can include:

1102—When a new chord plays, all of the possible chord qualities that the user has currently selected are displayed.

1104—Choosing the correct chord quality reveals the chord that is playing

Figure 12:
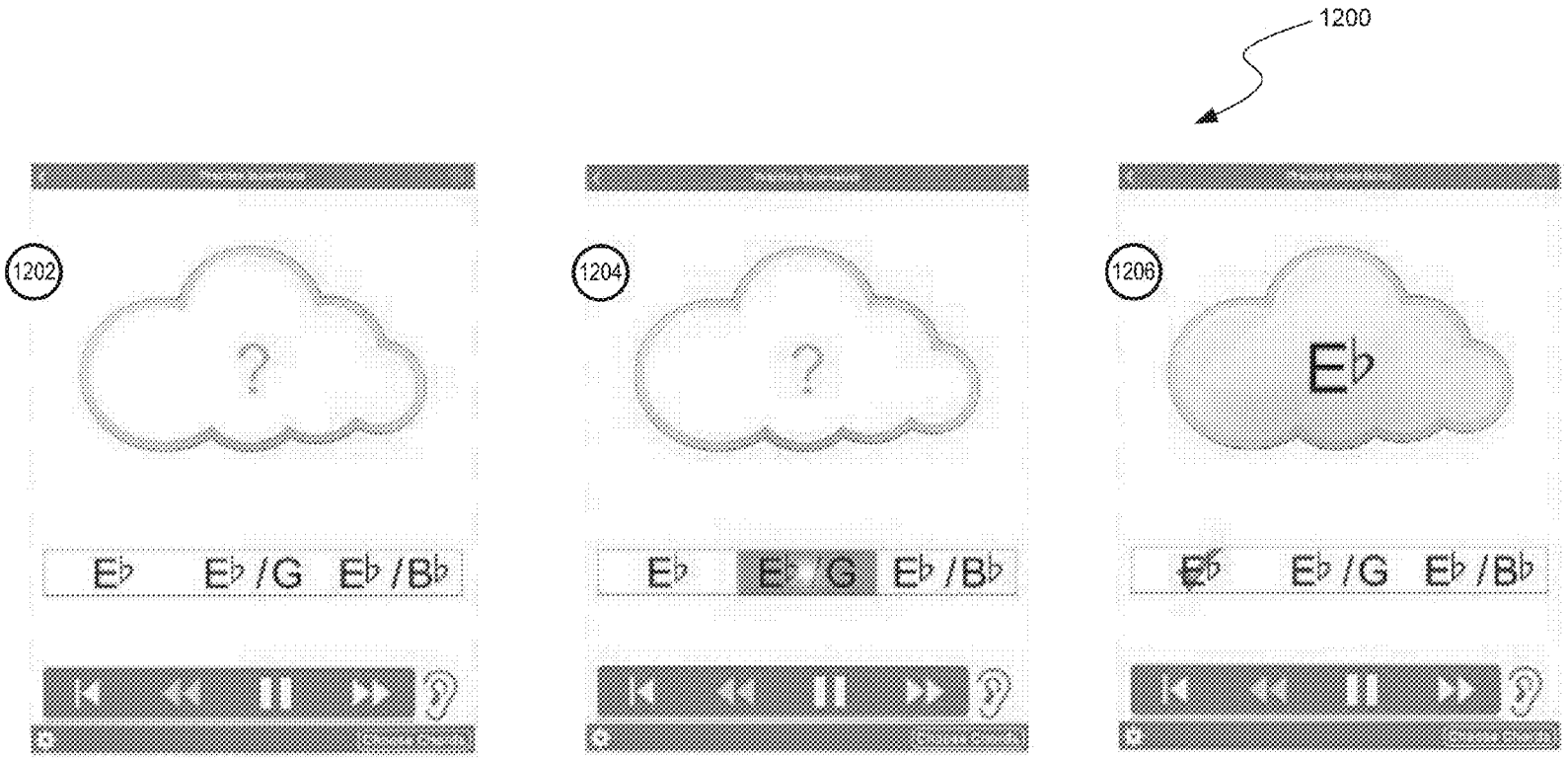
FIG. 12 shows a Practice Inversion GUI for some implementations of an app implementing the disclosed technology.

FIG. 12 shows a Practice Inversion GUI 1200 for some implementations of an app implementing the disclosed technology. Practice Inversion GUI 1200 can be used in some implementations to focus a user on inversion of a chord. In some implementations, an operation sequence can include:

1202—When a new chord plays, all of the possible inversions of the current chord that the user has selected are displayed.

1204—Choosing an incorrect inversion plays the incorrect bass note and provides visual feedback that their choice was incorrect.

1206—Choosing the correct inversion reveals the current chord.

Figure 13:
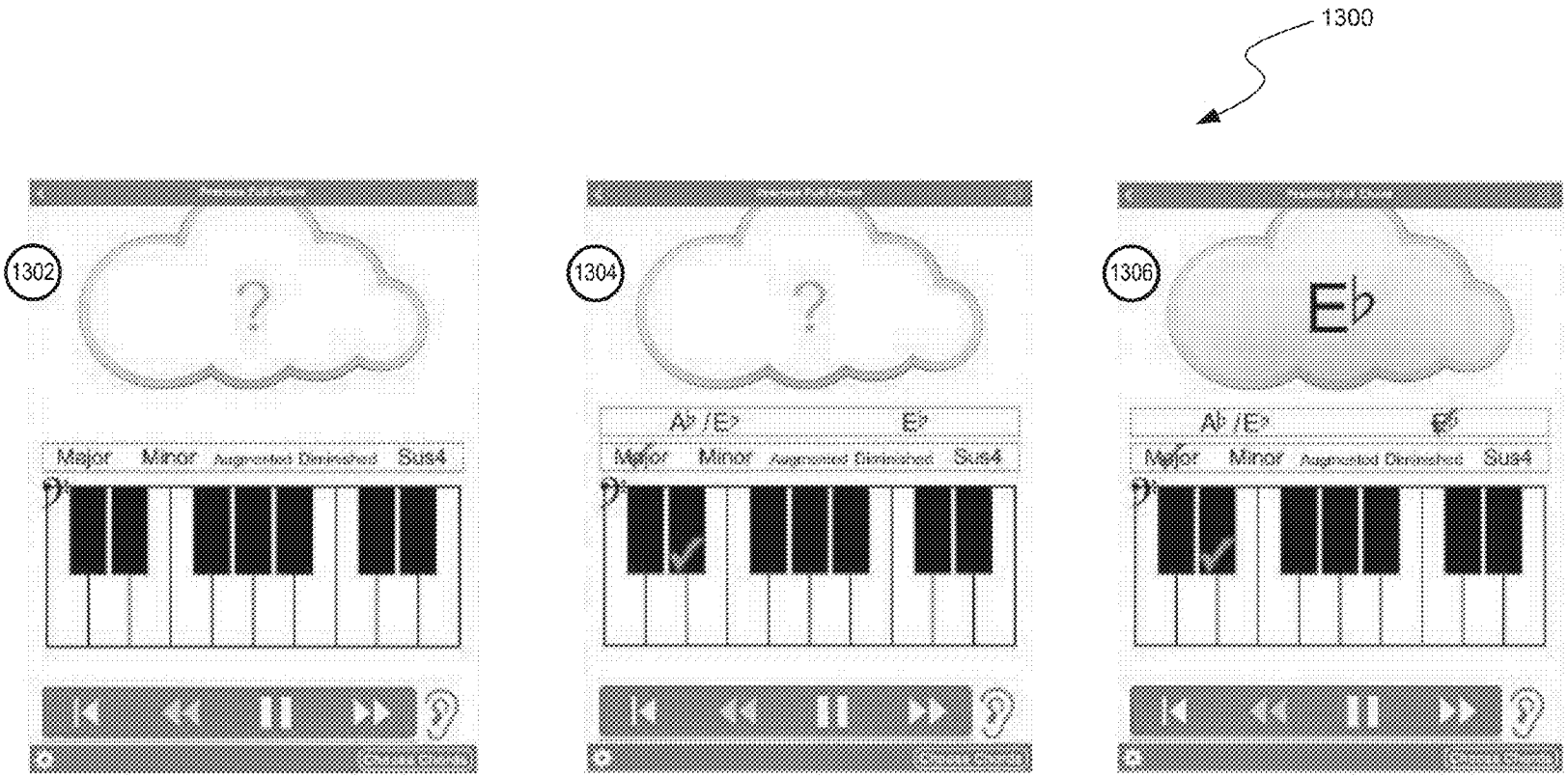
FIG. 13 shows a Practice Full Chord GUI for some implementations of an app implementing the disclosed technology.

FIG. 13 shows a Practice Full Chord GUI 1300 for some implementations of an app implementing the disclosed technology. A Practice Full Chord implementation can be used to have a user practice combining the skills of: identifying the bass note; chord quality; and inversion to fully identify a chord. In some implementations, an operation sequence can include:

1302—When the chord plays, you can identify either the chord quality or the bass note. Once both have been identified correctly the inversion chooser appears.

1304—All inversions that share the bass note are displayed.

1306—Choosing the correct inversion reveals the chord.

Figure 14:
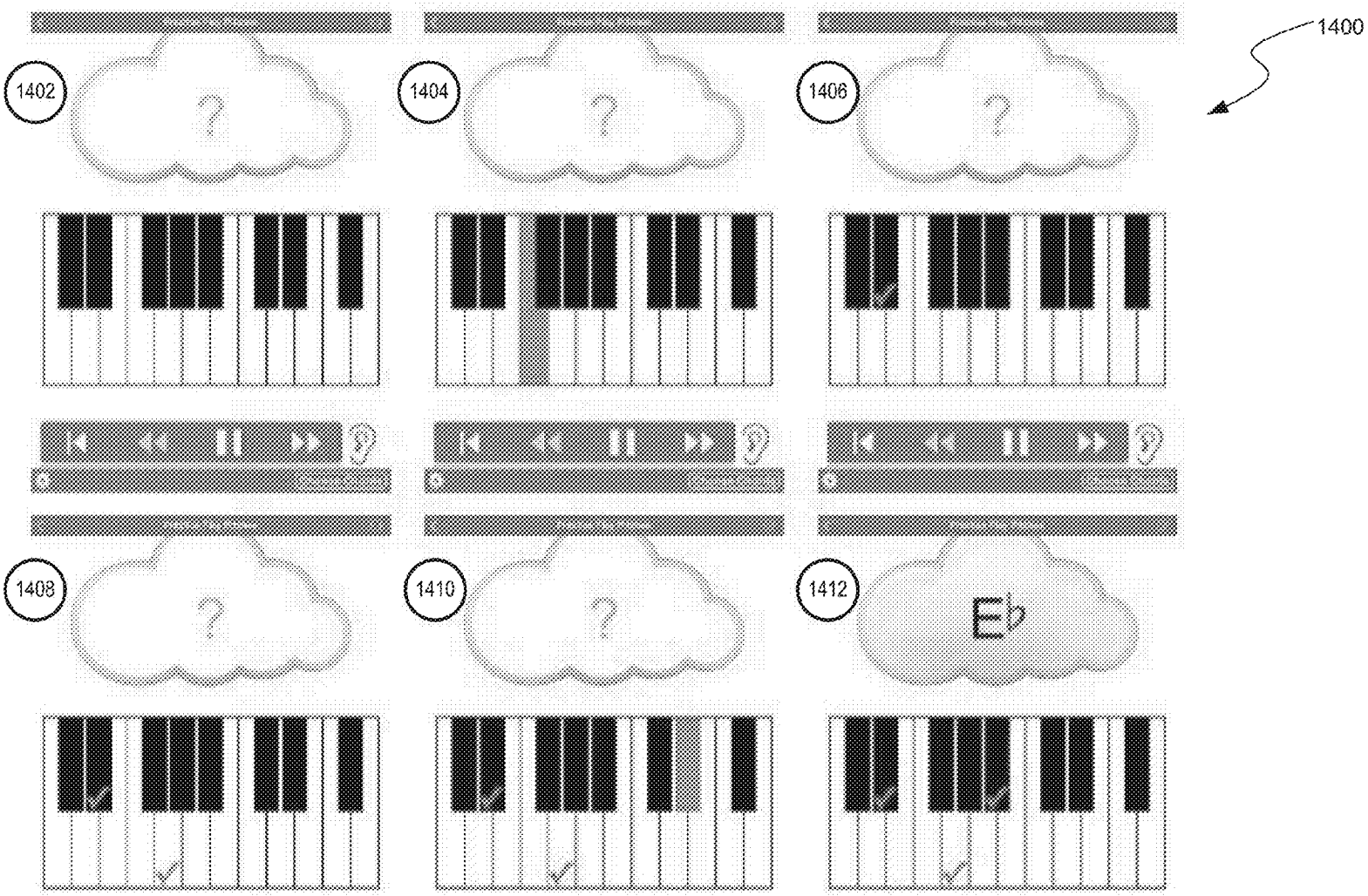
FIG. 14 shows a Practice Play Pitches GUI for some implementations of an app implementing the disclosed technology.

FIG. 14 shows a Practice Play Pitches GUI 1400 for some implementations of an app implementing the disclosed technology. The Practice Play Pitches GUI 1400 can provide an interface for users to hear and play some or all of the distinct pitches in a current chord. In some implementations, an operation sequence can include:

1402—Chord plays.

1404—If a user plays an incorrect note they will hear the incorrect pitch as well as receive visual feedback that the note was not a chord pitch.

1406—If a user plays the correct pitch they get visual feedback that they are correct, the correct note plays to reinforce their choice, and a visual icon appears on the keyboard.

1408—As they play more correct pitches, their correct choices are shown visually.

1410—Once a correct pitch has been played, playing it in another octave will indicate a correct pitch when the key is pressed, but a visual icon is not displayed.

1412—Playing all the correct pitches reveals the chord.

Take The Challenge

Figure 15:
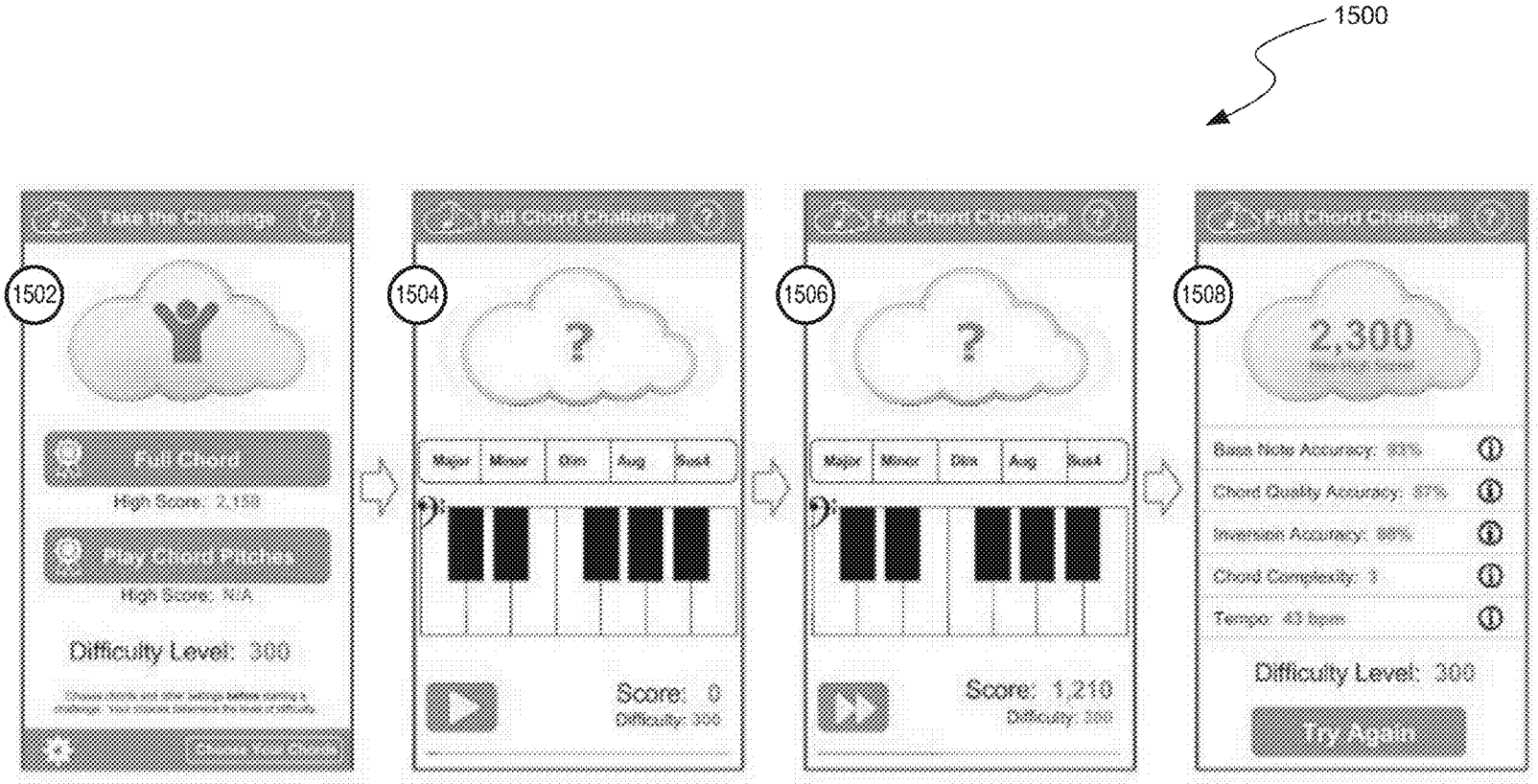
FIG. 15 shows a Take the Challenge GUI for some implementations of an app implementing the disclosed technology.

FIG. 15 shows a Take the Challenge GUI 1500 for some implementations of an app implementing the disclosed technology. A Take the Challenge implementation can assess a user's musical ability and gather user performance data. Various kinds of data gathered during the challenge can be used in many ways, including charting a user's progress over time and directing their practice regimen to be more effective. Data gathered during the challenge can be analyzed and used to help a user focus their ongoing practice in many ways, including the following:

Identify specific chord types that a user is unable to recognize reliably.

Identify specific chord progressions that are particularly challenging.

Identify certain kinds of bass line motion (for instance, specific intervals) that a user has difficulty recognizing.

Identify certain chord voicings and inversions that are more difficult for a user.

Identify specific skills which the user should focus on to better identify chords (for instance identifying bass note, top note, chord quality, inversion, or being able to play chord pitches).

Suggest how to configure the app to focus a user's practice time on skills that most need improvement.

In some implementations, an operation sequence for a Take the Challenge implementation can include:

1502—Prior to starting the challenge, a user can choose chords and all other settings as described above in the Settings section. These options may not be controllable by the user during the challenge.

1504—Once the challenge begins, the user tries to identify all chords played using methods that are available in the Practice area of the app.

1506—As the challenge progresses, the user sees his or her cumulative score. The score can be calculated using a number of factors including one or more of: accuracy, speed, and difficulty.

1508—When the challenge ends, a final score can be presented as well as additional information about the user's strengths and areas needing improvement. If the user reaches a personal high score, this can also be indicated.

Watch & Learn

Watch & Learn provides one tap access to a series of videos that teach users about harmony and how to use the app to deepen their understanding. We sometimes call this "the khan academy of harmony".

Additional Features

Your Progress—Detailed statistics on a user's progress over time.

Socialization—Direct connection to community. E.g. post high scores to facebook, twitter, share chord palette's (e.g., Nirvana's favorite chords).

Identifying chords by emotion—Many chords have distinct emotional content. For instance there are chords that feel triumphal like "a king entering the room", or awe-inspiring like "a cloud of shimmering light", or spine-chilling like "walking through a graveyard on a dark night". Teaching users to identify chords by recognizing their unique emotional content enables them to recognize chords faster and more intuitively.

Practice including pitch detection—User can play their physical instrument with the app and receive feedback. For example, play the pitches of a chord on their instrument to identify the chord, or have the app auto-harmonize with the melody that they are playing.

Sound Packs—Download additional sets of sounds that can be assigned to various parts of the music.

Beat Packs—Download "grooves" and styles of rhythmic accompaniment.

Personal Trainer—Automatically monitor a user's performance and adjust various aspects of generated music to personalize their learning experience.

While one method and associated system for automatically generating chord progressions is shown and described in detail herein, other methods are of course possible. For example, implementation can encode a series of rules for selecting chords in a chord progression. These rules may codify music theory that governs harmony in western music.

These rules include, for instance, resolving from a major V ("dominant") chord to the major I ("tonic"). More advanced rules govern the resolution of each fundamental type of triad (major, minor, diminished, sus4, and augmented. Rules may also be applied based on the root pitch of the triad and its relation to the tonic of the key signature. Upwards of 50 various rules or more may be used to select each successive chord in a chord progression. While this approach may generate musical and unpredictable progressions, it may be less flexible than a pathways database.

Overall a music composition and training system described herein provides musicians of all skill levels the opportunity to learn and utilize aspects of music such as the language of harmony, improvising, composing new chord progressions and songs, reharmonizing existing songs, performing unpredictable music live, or generating music suited to certain applications. The music composition and training system can incorporate the following elements: a database comprising indications of chords and/or harmonic progressions; algorithms for evolving and enhancing the database; a tagging system that can enable selection of chords for chord progressions based on criteria such as musical genre, emotional content, harmonic density, and relation to key center; a chord generator that can produce highly musical, unpredictable chord progressions; a music generator that can generate music; interactive harmonic ear training exercises; or a suite of applications that can utilize the above elements The above Detailed Description of examples of the technology is not intended to be exhaustive or to limit the technology to the precise form disclosed above. While specific examples for the technology are described above for illustrative purposes, various equivalent modifications are possible within the scope of the technology, as those skilled in the relevant art will recognize. For example, while processes or blocks are presented in a given order, alternative implementations may perform routines having steps, or employ systems having blocks, in a different order, and some processes or blocks may be deleted, moved, added, subdivided, combined, and/or modified to provide alternative or sub-combinations. Each of these processes or blocks may be implemented in a variety of different ways. Also, while processes or blocks are at times shown as being performed in series, these processes or blocks may instead be performed or implemented in parallel, or may be performed at different times. Further, any specific numbers noted herein are only examples: alternative implementations may employ differing values or ranges.

The teachings of the technology provided herein can be applied to other systems, not necessarily only to the system described above. The elements and acts of the various examples described above can be combined to provide further implementations of the technology. While some alternative implementations of the technology may include additional elements to those implementations noted above, others may include fewer elements.

These and other changes can be made to the technology in light of the above Detailed Description. While the above description describes certain examples of the technology and describes the best mode contemplated, no matter how detailed the above appears in text, the technology can be practiced in many ways. Details of the system may vary considerably in its specific implementation, while still being encompassed by the technology disclosed herein. As noted above, particular terminology used when describing certain features or aspects of the technology should not be taken to imply that the terminology is being redefined herein to be restricted to any specific characteristics, features, or aspects of the technology with which that terminology is associated. In general, the terms used in the following claims should not be construed to limit the technology to the specific examples disclosed in the specification, unless the above Detailed Description section explicitly defines such terms. Accordingly, the actual scope of the technology encompasses not only the disclosed examples, but also all equivalent ways of practicing or implementing the technology under the claims.

To reduce the number of claims, certain aspects of the technology are presented below in certain claim forms, but the applicant contemplates the various aspects of the technology in any number of claim forms. For example, while only one aspect of the technology is recited as a computer-readable medium claim, other aspects may likewise be embodied as a computer-readable medium claim, or in other forms, such as being embodied in a means-plus-function claim. Any claims intended to be treated under 35 U.S.C. §112(f) will begin with the words "means for", but use of the term "for" in any other context is not intended to invoke treatment under 35 U.S.C. §112(f). Accordingly, the applicant reserves the right to pursue additional claims after filing this application to pursue such additional claim forms, in either this application or in a continuing application.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Any patents, patent applications, and other references noted above are incorporated herein by reference. Aspects can be modified, if necessary, to employ the systems, functions, and concepts of the various references described above to provide yet further implementations. If statements or subject matter in a document incorporated by reference conflicts with statements or subject matter of this application, then this application shall control.

We claim:

1. A computer-readable storage medium, excluding transitory signals, and storing instructions that, when executed by a computing system, cause the computing system to perform operations for music composition or training, the operations comprising:

accessing identified chord pairings classified as pathways, wherein a pathway is a data record identifying two or more chords having a sequence between the two or more chords;

identifying an initial chord of a chord progression;

for multiple iterations, selecting a chord of the chord progression, and for each iteration of the multiple iterations:

identifying one or more of the pathways that have the selected chord as a first chord of the identified one or more pathways;

weighting a second chord of the identified one or more pathways;

selecting a pathway of the identified one or more pathways based on the weighting; and combining the second chord of the selected pathway into the chord progression; and using the chord progression to generate music, wherein in a first iteration of the multiple iterations, the initial chord is selected.

2. The computer-readable storage medium of claim 1, wherein at least one of the chord pairings is classified as a pathway by being manually or programmatically identified in existing music.

3. The computer-readable storage medium of claim 1, wherein at least one of the chord pairings is classified as a pathway based on manual user selections of chord pairings.

4. The computer-readable storage medium of claim 1, wherein weighting the second chord of the identified one or more pathways in at least one of the iterations is based on a value assigned to maintain a statistical distribution of chords across the chord progression; and wherein the statistical distribution of chords is based on a chord distribution computed based on previous chord selections by a user.

5. The computer-readable storage medium of claim 1, wherein weighting the second chord of the identified one or more pathways in at least one of the iterations is based on an identified emotional quality for the chord progression.

6. The computer-readable storage medium of claim 1, wherein weighting the second chord of the identified one or more pathways in at least one of the iterations is based on an identified musical genre for the chord progression.

7. The computer-readable storage medium of claim 1, wherein weighting the second chord of the identified one or more pathways in at least one of the iterations is based on an identified relation of the pathway to a key center for the chord progression.

8. The computer-readable storage medium of claim 1, wherein weighting the second chord of the identified one or more pathways in at least one of the iterations is based on a source that the pathway was initially identified from.

9. The computer-readable storage medium of claim 1, wherein weighting the second chord of the identified one or more pathways in at least one of the iterations is based on whether the pathway or chords from the pathway have been selected for inclusion in the chord progression by a user.

10. The computer-readable storage medium of claim 1, wherein identifying an initial chord of the chord progression comprises selecting a default chord or receiving a user identified initial chord.

11. The computer-readable storage medium of claim 1, wherein, in each iteration after the first iteration, the selected chord is the second chord of the selected pathway from the previous iteration.

12. A computer-readable storage medium, excluding transitory signals, and storing instructions that, when executed by a computing system, cause the computing system to perform operations for music composition or training, the operations comprising:

identifying a first chord of a chord progression;

for multiple iterations, selecting a chord of the chord progression, and for each iteration of the multiple iterations:

identifying one or more potential subsequent chords in such a way that each of the potential subsequent chords provide a musical progression, applying weighted criteria to each of the potential subsequent chords, selecting a second chord based on the weighting while also providing variety and unpredictability, and combining the second chord into the chord progression; and using the chord progression to generate music, wherein in a first iteration in the multiple iterations, the first chord is selected.

13. The computer-readable storage medium of claim 12, wherein at least one of the potential subsequent chords is classified as a pathway by being manually or programmatically identified in existing music, wherein the pathway is a data record identifying two or more chords having a sequence between the two or more chords.

14. The computer-readable storage medium of claim 12, wherein at least one of the potential subsequent chords is classified as a pathway based on manual user selections of chord pairings, wherein the pathway is a data record identifying two or more chords having a sequence between the two or more chords.

15. The computer-readable storage medium of claim 12, wherein weighting the each of the potential subsequent chords is based on a value assigned to maintain a statistical distribution of chords across the chord progression; and wherein the statistical distribution of chords is based on a chord distribution computed based on previous chord selections by a user.

16. The computer-readable storage medium of claim 12, wherein weighting the each of the potential subsequent chords is based on an identified emotional quality for the chord progression.

17. The computer-readable storage medium of claim 12, wherein weighting the each of the potential subsequent chords is based on an identified musical genre for the chord progression.

18. The computer-readable storage medium of claim 12, wherein weighting the each of the potential subsequent chords is based on an identified relation of a pathway to a key center for the chord progression, wherein the pathway is a data record identifying two or more chords having a sequence between the two or more chords.

19. The computer-readable storage medium of claim 12, wherein weighting the each of the potential subsequent chords is based on a source that a pathway was initially identified from, wherein the pathway is a data record identifying two or more chords having a sequence between the two or more chords.

20. The computer-readable storage medium of claim 12, wherein identifying the first chord of the chord progression comprises selecting a default chord or receiving a user identified first chord.

* * * * *